US005838242A

United States Patent [19]

Marsden

[11] Patent Number: 5,838,242

[45] Date of Patent: Nov. 17, 1998

[54] FIRE DETECTION SYSTEM USING MODULATION RATIOMETRICS

[75] Inventor: Gary C. Marsden, Austin, Tex.

[73] Assignee: Whittaker Corporation, Simi Valley, Calif.

[21] Appl. No.: 947,501

[22] Filed: Oct. 10, 1997

[51] Int. Cl.[6] ..... G08B 17/10

[52] U.S. Cl. ..... 340/628; 340/578; 340/577

[58] Field of Search ..... 340/628, 629, 340/630, 577, 578, 579, 508, 511, 522, 584; 250/554, 575

[56] References Cited

U.S. PATENT DOCUMENTS

| | | | |
|---|---|---|---|
| 4,004,288 | 1/1977 | Webb, Jr. | 340/628 |
| 4,401,978 | 8/1983 | Solomon | 340/628 |
| 4,871,999 | 10/1989 | Ishii et al. | 340/628 |
| 4,935,952 | 6/1990 | Dutra | 340/628 |
| 5,381,130 | 1/1995 | Thuillard et al. | 340/630 |

*Primary Examiner*—Jeffery A. Hofsass
*Assistant Examiner*—Anh La
*Attorney, Agent, or Firm*—Henry M. Bissell

[57] ABSTRACT

The present invention utilizes the modulation ratio between the flicker of a sensor signal and the absolute signal average to detect fire conditions. The system of the present invention requires that the signal on a sensor channel be above a certain threshold and the ratio of the flickering portion of the signal to the absolute signal average be within a certain range. The system may be applied to any sensor signal in response to any source, including, but not limited to, radiation, acoustic or optical signals including ultraviolet, visible or infrared radiation. Signals may be filtered with a median filter to remove noise. A least-mean-square curve-fit is made to the data to account for any growth or decay in the fire signal. The flicker can be calculated using any of several metrics such as standard deviation, p-norms, or maximum deviation, but mean deviation seems to provide optimal performance. The modulation ratio system can be augmented with a separate detection scheme for large-scale fires. The system can also be modified to allow for increased sensitivity in the case of a previous alarm condition. Multi-channel modulation ratio systems may be configured such that each channel's corresponding ratio and absolute signal average must meet the corresponding requirements before a fire alarm is declared. Multi-channel systems may include a form of cross-thresholding wherein the threshold of one channel is dependent upon the signal levels of the other remaining channels.

28 Claims, 4 Drawing Sheets

FIRE DETECTION SYSTEM USING MODULATION RATIOMETRICS

BACKGROUND OF THE INVENTION

1. Field of the Invention

This invention relates generally to fire detection systems and more particularly to optical and acoustical sensing systems which provide immunity to false alarm conditions.

2. Description of the Related Art

Several patents are concerned with ratiometric algorithms for flame detection. The class of multi-channel ratiometric algorithms is represented by: U.S. Pat. No. 4,220,857 of Bright; U.S. Pat. No. 4,414,542 of Farquhar et al.; U.S. Pat. No. 5,373,159 of Goldenberg et al.; and U.S. Pat. No. 4,691,196 of Kern et al. In this class of algorithms, a ratio is taken of the signals from two sensors with differing spectral responses. At least one sensor is tuned to a typical fire emission waveband. The other may be tuned to another typical fire emission or to a reference channel. The ratio must fall within a given range which depends on the particular wavebands.

The class of multi-metric ratiometric algorithms is another class of ratiometric algorithms for fire detection. This class is represented by U.S. Pat. No. 4,750,142 of Akiba et al. and 4,665,390 of Kern et al. In this class of algorithms, the flicker of a sensor signal is measured by two separate metrics. The ratio between the values of these two metrics must fall within a given range to initiate a fire alarm.

In the case of the '142 patent, one metric measures the positive deviations of a signal while the other metric measures the negative deviations of the signal. The resulting ratio is used to measure the asymmetry of the signal about its average.

In the case of the '390 patent, the kurtosis is used to discriminate fires. The kurtosis is defined as the ratio between the fourth moment of the signal about its average and the square of the second moment of the signal about its average. Approximations are allowed for the calculation of the kurtosis. The purpose of the kurtosis is to measure the randomness in the amplitude distribution. Should the amplitudes cluster about a few values, as is the case for square waves, then the kurtosis is low. On the other hand, the kurtosis is high for random, or at least chaotic, signals. The '390 patent rejects signals with a kurtosis under 2.4. Note that the kurtosis is a ratio of two different measures of the deviation in the signal.

The modulation ratio system of the present invention differs from the multi-metric ratiometric algorithms in that it utilizes one measure of the deviation of the signal and one measure of the absolute signal in the ratio. One advantage of such a system can be seen in the following examples. It is possible to construct two signals having identical deviations, the signals differing only by a constant value. In the case of the multi-metric ratiometric algorithms these two signals would produce identical values and fail to detect a fire condition, whereas the modulation ratio system of the present invention would produce differing values and its ability to detect a fire condition would be retained. The modulation ratio system is quite different from the multi-channel ratiometric algorithms in that the two values used in each ratio of the multi-channel ratiometric algorithms are derived from a single sensor. The present invention may be embodied in a multi-channel modulation ratio system, but in such a case each channel would produce a corresponding modulation ratio.

SUMMARY OF THE INVENTION

The modulation ratio system of the present invention requires that the signal on a sensor channel be above a prescribed threshold value and that the ratio of the flickering portion of the signal to the absolute signal level be within a prescribed range. The system can be applied to any radiation sensor signal, such as acoustic signals or optical signals, including ultraviolet, visible, and infrared radiation, but is best applied in a multi-channel system using a 4.4 um optically filtered thermopile and a 940 nm responsive photodiode.

The system was developed and verified using data collected with a PC-based data acquisition board and a sensor array. Data was collected for fires as well as for various false alarm sources including mechanical shop equipment, lamps, and sunlight. The system can detect a 1'×1' (one foot square) gasoline fire at steady-state at a range of 50 feet within 5 seconds and is immune from various false alarm sources under certain reasonable constraints.

The system begins by sampling 5.12 seconds of data, consisting of 128 samples per channel when sampled at 25 Hz. These samples are filtered using a three-point median filter to remove noise. A three-point median filter passes the median value of the current value and the previous two values. The median filter removes spurious noise but maintains important features in the data such as edges. A least-mean-square (LMS) curve-fit is made to the data to account for any growth or decay in the fire signal.

If s(t) is the original sensor data and L(t) is the LMS fit of the data, the flicker $\|f\|$ is defined according to $$\|f\| = \frac{1}{N}\sum_{t=0}^{N-1}|s(t) - L(t)| \tag{1}$$

where N is the number of samples. The absolute signal average (ASA) or <s> is then calculated, $$\langle s\rangle = \frac{1}{N}\sum_{t=0}^{N-1} s(t) \tag{2}$$

Note that s(t) must be an absolute measure. That is, s(t) must be proportional to the incident irradiance without a bias, except for bias introduced to compensate for long-term background radiation. The modulation ratio R is then calculated from the flicker and the ASA, $$R = \frac{\|f\|}{\langle s\rangle} \tag{3}$$

In order for a fire condition to be declared, two conditions must be met on each channel. The channel's modulation ratio R must be within a set range, and the channel's ASA must be above a threshold value. This threshold value for the ASA is set above the typical background signal from the sensor. A 4.4 um sensor is particularly useful for differentiating between fire sources with high irradiance and false alarm sources with low irradiance. If a rite condition is not declared, the system collects T more samples and repeats for the most recent N samples. Note that T is selected to provide the desired refresh rate and can be as low as 1. That is, the system can be reevaluated after each sample if desired.

The modulation ratio system can be augmented with a separate detection scheme for large-scale fires. It is well known that the flicker of fires is inversely related to the size of the fire. Hence, any scheme that relies on flicker is susceptible to missing large fires.

An augmenting scheme for detection of large fires may provide a threshold for low to medium intensity fires and a large fire threshold for higher intensity fires. A large fire augmentation scheme may also define an acceptable range for the modulation ratio. When either the large fire threshold is exceeded or both the threshold and the acceptable range of the modulation ratio have been exceeded, then a detected fire condition is established. To prevent false alarms, the large fire threshold may be set quite high in relation to expected background levels.

The system may also be modified to consider previous alarm conditions. Such an alarm history scheme may more readily detect flare-ups from a previous fire while serving to limit the overall number of alarms. If an alarm has recently been declared but the system has resumed a non-alarm state, an alarm history scheme may relax the threshold value and/or ratio parameters to provide increased sensitivity. This increased sensitivity is desirable due to the higher probability of a true fire condition given a recent fire. Also, the radiation from a flare-up may be partially obscured by previously released fire suppressant or smoke from a previous fire.

Several other metrics can be used to measure the flicker in the data. For example, the standard deviation of the data $$\|f\| = \sqrt{\frac{1}{N}\sum_{i=0}^{N-1}|s(t)-L(t)|^2} \tag{4}$$

could be used to measure the flicker. More generally, metrics parameterized by p of the form $$\|f\| = \sqrt[p]{\frac{1}{N}\sum_{i=0}^{N-1}|s(t)-L(t)|^p} \tag{5}$$

called p-norms, can be used to measure the flicker of the signal. Note that the maximum deviation occurs in the limit as p approaches infinity, $$\|f\| = \underset{i=0}{\overset{N-1}{\mathrm{MAX}}}\,|s(t)-L(t)| \tag{6}$$

The preferred embodiment of the system uses the mean deviation which occurs for p=1. The mean deviation appears to have the tightest distribution for fire data and is also easily calculated.

The basic modulation ratio system uses DC-coupled sensors and A/D conversion. The minimum bit resolution is determined by the resolution requirements in the ratio and the range of signals expected.

One solution to reduce tile resolution requirements is to use adaptive gain control. In this way, the difference between adjacent resolvable levels at higher signals can be increased while maintaining the desired accuracy of the ratio determination. The range could be divided amongst several separate amplifiers, which are multiplexed into a lower accuracy A/D converter.

Another solution is to separately AC filter and DC filter the sensor signal. The AC channel would correspond to the flicker, while the DC channel would be used to provide the absolute signal. Both could be sampled with a low resolution A/D converter providing ample resolution to achieve the desired accuracy in the ratio calculation. The ratio parameters would be adjusted according to the gains and bandwidths of the AC and DC filters.

Multi-channel modulation ratio systems can be arranged wherein each channel's corresponding ratio and absolute signal average must meet the corresponding requirements before a fire alarm is declared. Another addition to multi-channel modulation ratio systems is to include a form of cross-thresholding. In cross-thresholding, the threshold value of one channel is dependent on the signal levels of the other channels. In the case of a large fire, the signals on all channels should be relatively high. A situation in which all channels are above threshold values, but one signal is quite large compared to the others can be suspect. Cross-thresholding can be useful to reject false alarm conditions of this type, since the threshold on the weaker signals would be increased due to the large signal.

In particular arrangements in accordance with the invention, the provision of an alarm history stage, which maintains a record of previous alarms, may improve fire detection capability under certain fire conditions. In such arrangements, if an alarm has recently been declared but the detector has resumed a non-alarm state, the threshold modulation ratio parameters can be relaxed to allow for increased sensitivity. In this way, flare-ups can be detected while providing for limited alarms which may be desirable. The increased sensitivity is desirable due to the higher probability of a true fire condition, given a recent fire.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
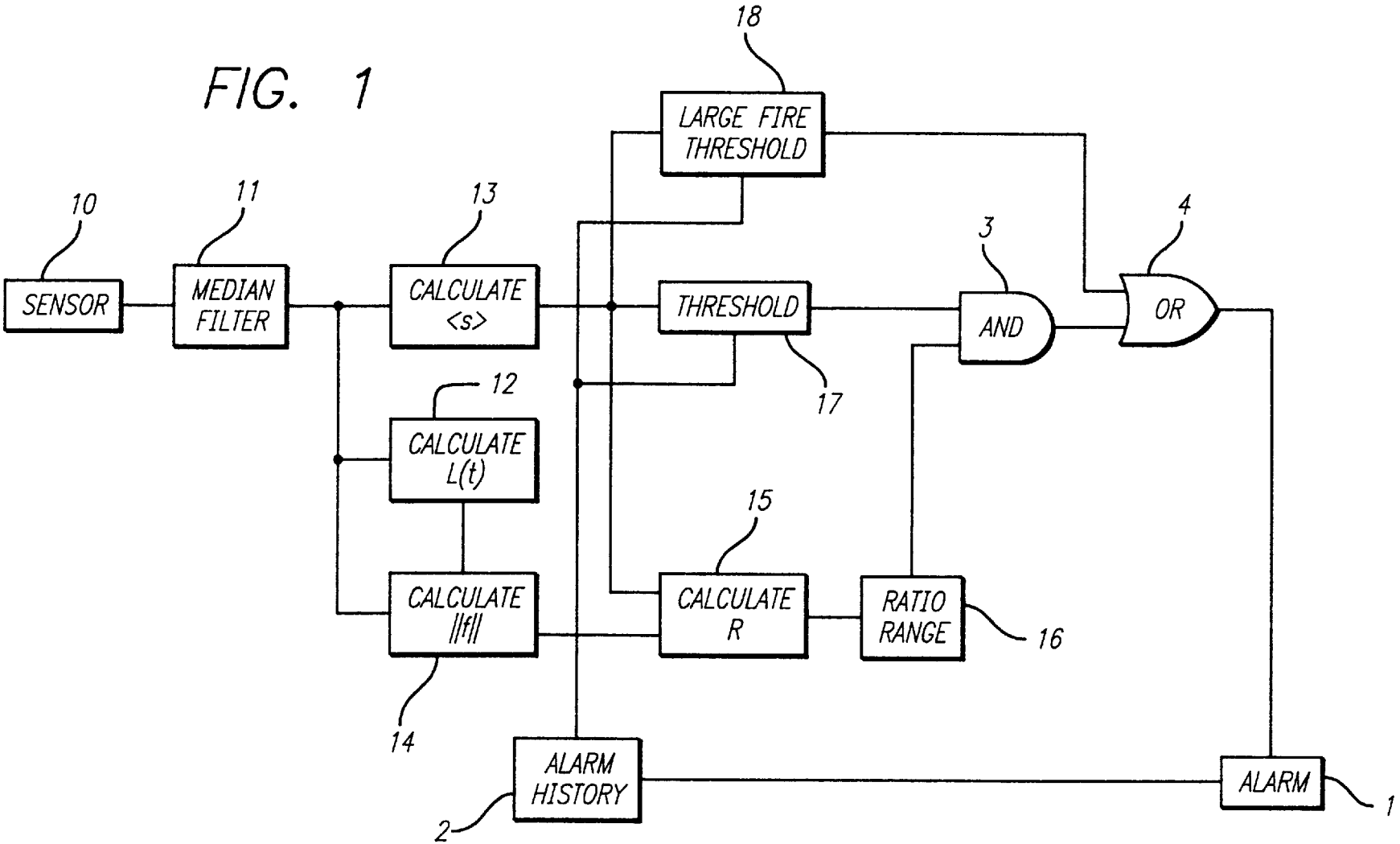
FIG. 1 is a block diagram showing a single channel variant of the present invention.

In The single channel variant of the present invention, as illustrated diagrammatically in FIG. 1, comprises a sensor 10 responsive to incident radiation typical of fires. The signal from the sensor is processed by a median filter 11 to remove noise. The filtered signal is processed in a processing stage 12 so as to calculate a baseline to the signal, and in a processing stage 13 so as to calculate an absolute signal average. The filtered signal and baseline are processed in a processing stage 14 so as to calculate the flicker of the signal. A modulation ratio of the flicker to absolute signal average is calculated in processing stage 15.

In processing stage 16, the modulation ratio is compared to a prescribed range. If the modulation ratio is found by processing stage 16 to be within a prescribed range, while the absolute signal average exceeds a prescribed threshold value, as determined by stage 17, then an alarm condition 1 is established indicating the presence of fire.

In addition, a large fire augmentation stage 18 is provided to account for situations where the large size of a fire necessarily pushes the flicker component outside the prescribed range, which would otherwise render such a fire "invisible" to the system. Note that the threshold values in stages 17 and 18 depend on the alarm history 2. Logic stages 3 and 4 provide the conjunctive and disjunctive functions necessary to produce the alarm condition.

Figures 1, 2:
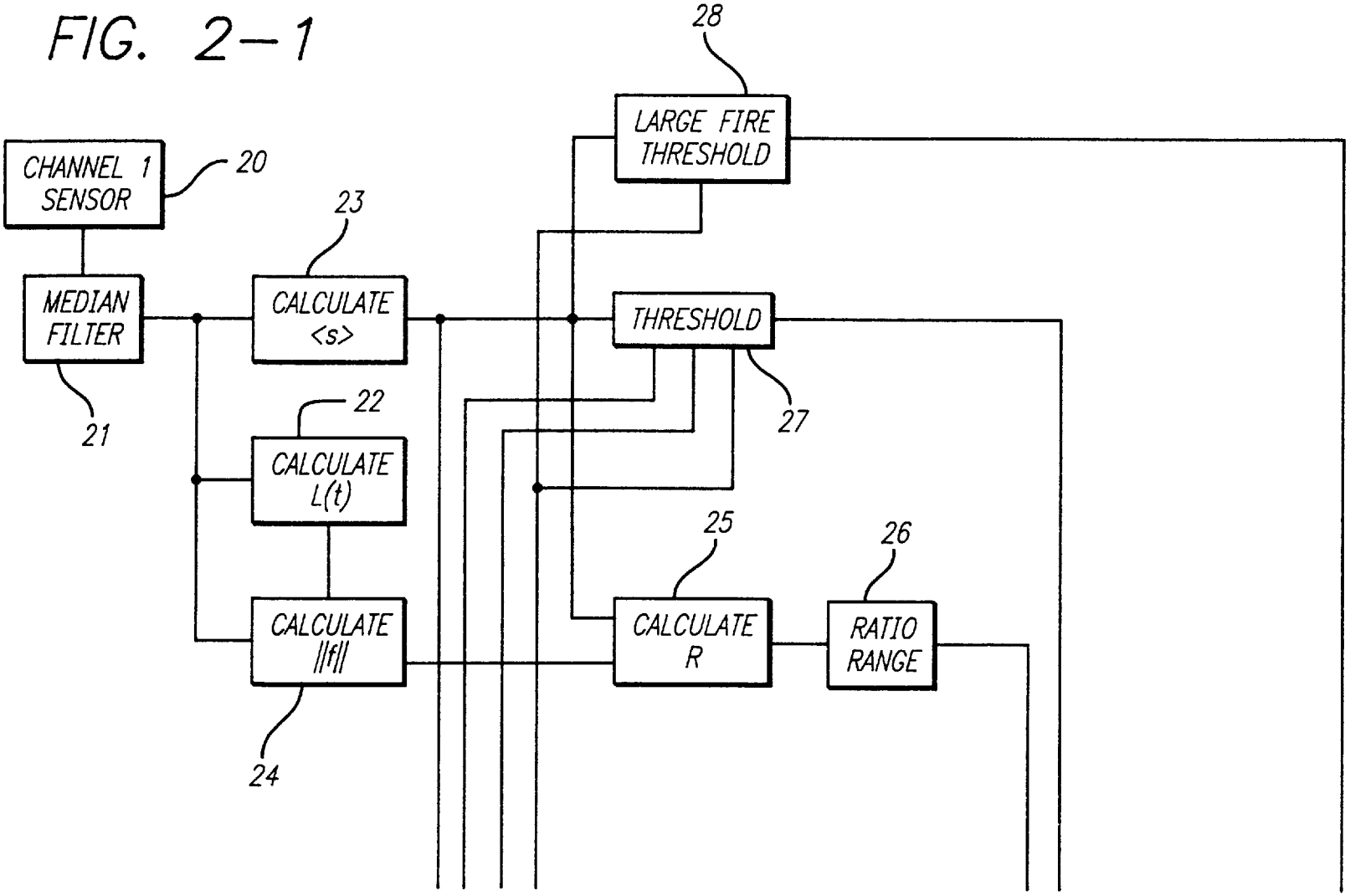
FIG. 2 is a block diagram showing a multi-channel variant of the present invention.
Figure 2:
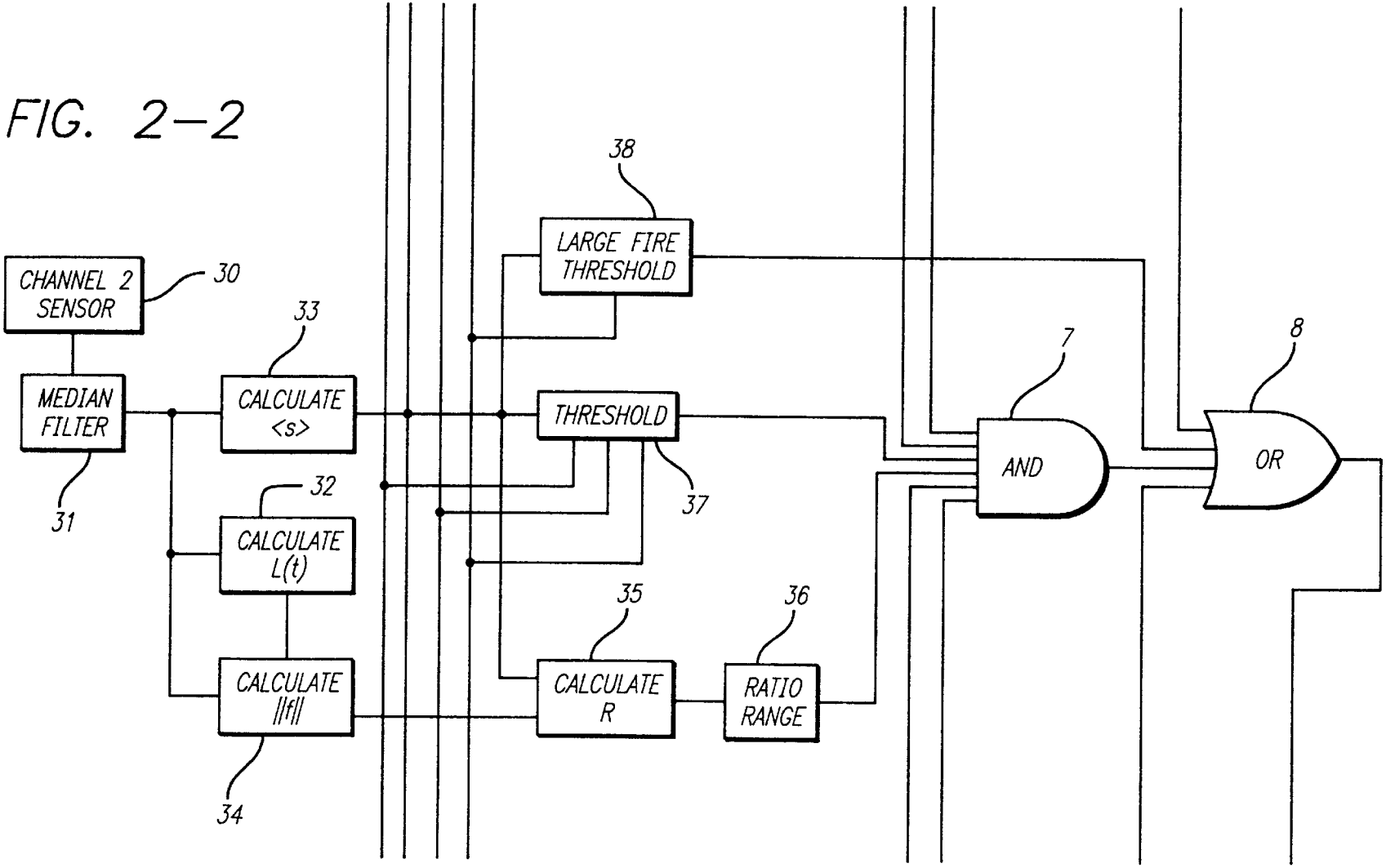
Figures 2, 3:
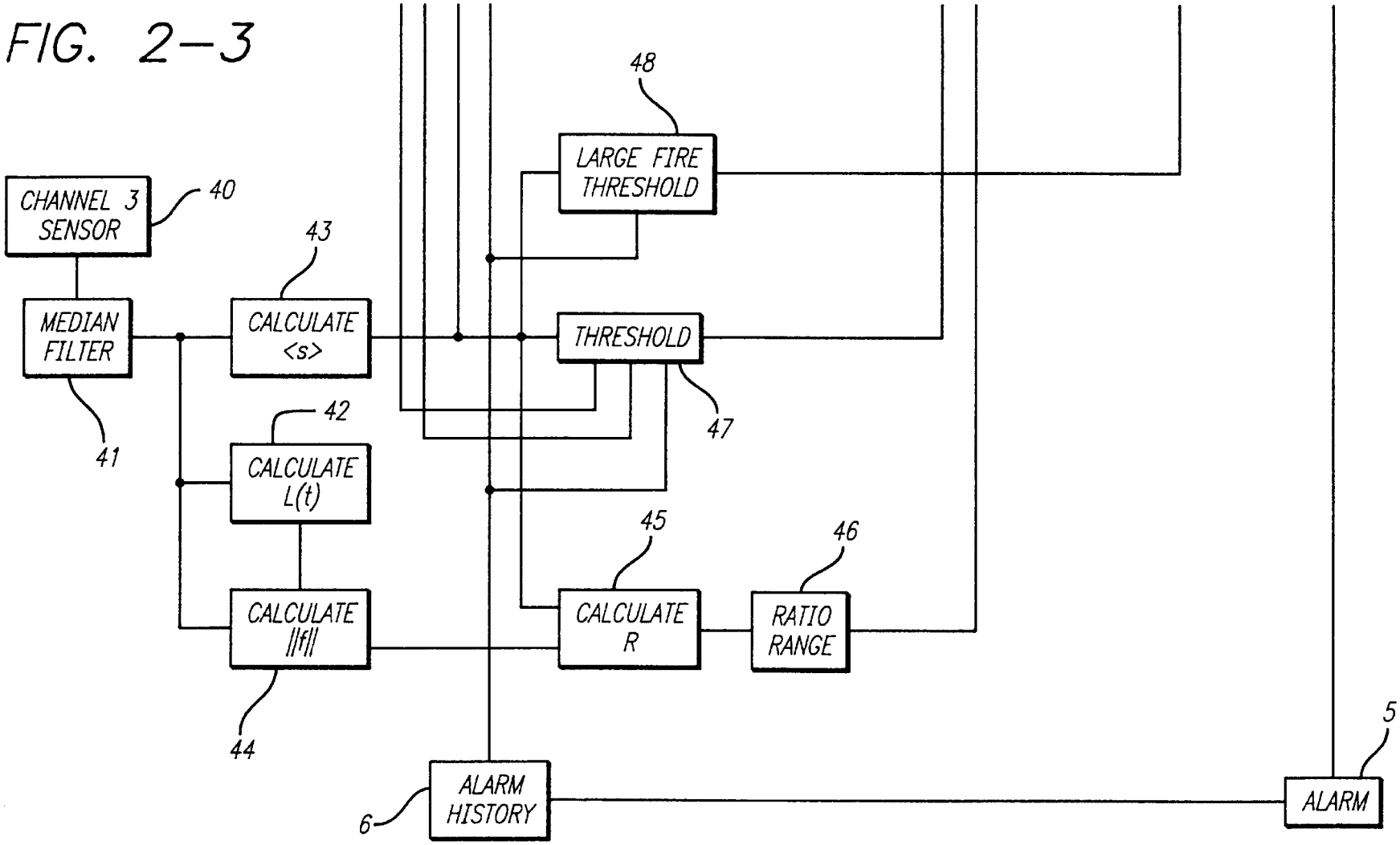

The multi-channel variant of the present invention is illustrated diagrammatically in FIG. 2 with three channels, but may be implemented with any number of channels greater than one. It comprises an array of sensors 20, 30 and 40 responsive to separate bands of incident radiation typical of fires. Signals from sensors 20, 30 and 40 are processed by median filters 21, 31 and 41, respectively, to remove noise. The filtered signals are processed in processing stages 22, 32 and 42 so as to calculate baselines to the signals, and in processing stages 23, 33 and 43 so as to calculate absolute signal averages. The filtered signals and accompanying baselines are processed in processing stages 24, 34 and 44 so as to calculate the flicker of each signal.

Modulation ratios of the flicker to absolute signal average for each channel are calculated in processing stages 25, 35 and 45. In processing stages 26, 36 and 46, the modulation ratios are compared to a prescribed range. If the modulation ratios are found by processing stages 26, 36 and 46 to be within a prescribed range, while the absolute signal averages exceed a prescribed threshold value, as determined by stages 27, 37 and 47, then an alarm condition 5 is established indicating the presence of fire. In addition, large fire augmentation stages 28, 38 and 48 are provided for situations where the large size of a fire necessarily pushes the flicker components outside the prescribed range, which would otherwise render such a fire "invisible" to the system. Note that the threshold values in stages 27, 28, 37, 38, 47 and 48 are dependent upon the alarm history 2. Note also that the prescribed threshold value in stage 27 depends upon the absolute signal averages for the remaining channels as determined in stages 33 and 43. Similarly, the prescribed threshold values in stages 37 and 47 depend on the absolute signal averages for the remaining channels. Logic stages 7 and 8 provide the conjunctive and disjunctive functions necessary to produce the alarm condition.

Although there have been described hereinabove various specific arrangements of a FIRE DETECTION SYSTEM USING MODULATION RATIOMETRICS in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A method of establishing a detected fire condition from a source of incident radiation, said method comprising the steps of:

generating a sensor signal from a sensor responsive to incident radiation;

generating an absolute signal from said sensor signal;

determining an absolute signal average from said absolute signal;

generating a flicker signal from said absolute signal;

determining a flicker value from said flicker signal;

calculating a modulation ratio from said flicker value and said absolute signal average; and providing an indication of a detected fire condition when said absolute signal average exceeds a predetermined threshold value and said modulation ratio is within a selected range of values.

2. The method of claim 1, wherein said sensor is responsive to acoustic radiation.

3. The method of claim 1, wherein said sensor is responsive to electromagnetic radiation.

4. The method of claim 3, wherein said sensor is responsive to a restricted bandwidth of electromagnetic radiation.

5. The method of claim 4, including the step of using an optical filter to restrict said bandwidth of electromagnetic radiation.

6. The method of claim 1, wherein said sensor is a thermopile.

7. The method of claim 5, including the step of using an optically filtered thermopile to restrict said bandwidth to include 4.4 um. infrared radiation.

8. The method of claim 1, wherein said sensor is a photodiode.

9. The method of claim 4, including the step of using a photodiode to restrict said bandwidth to include 940 nm. ultraviolet radiation.

10. The method of claim 1, wherein the step of generating said absolute signal includes using a DC filter.

11. The method of claim 1, wherein the step of generating said absolute signal includes generating said absolute signal devoid of bias from background radiation.

12. The method of claim 1, wherein the step of generating said absolute signal includes the steps of sampling an interval of said sensor signal at a selected rate and collecting a plurality of samples derived from said sampling.

13. The method of claim 1, wherein the step of generating said absolute signal includes using a median filter to remove noise.

14. The method of claim 1, wherein the step of generating said flicker signal includes using an AC filter.

15. The method of claim 1, wherein the step of generating said flicker signal includes using a three-point median filter to remove noise.

16. The method of claim 1, wherein the step of generating said flicker signal includes the steps of sampling an interval of said sensor signal at a selected rate and collecting a plurality of samples derived from said sampling; and further including the step of generating a baseline determined by said flicker signal.

17. The method of claim 16, wherein the step of generating said baseline includes determining an average of said flicker signal.

18. The method of claim 16, wherein the step of generating said baseline includes determining a least-mean-square curve-fit of said collected samples.

19. The method of claim 16, wherein the step of determining said flicker value includes determining a p-norm of the deviation of said collected samples about said baseline.

20. The method of claim 16, wherein the step of determining said flicker value includes determining a mean deviation of said collected samples about said baseline.

21. The method of claim 16, wherein the step of determining said flicker value includes determining the maximum deviation of said collected samples about said baseline.

22. The method of claim 1, further including the steps of establishing a preselected large fire threshold value, comparing said absolute signal to said large fire threshold value in a large fire augmentation scheme, and providing an indication of a detected fire condition when said absolute signal exceeds said large fire threshold value.

23. The method of claim 1, further including the steps of establishing a preselected large fire threshold value, comparing said absolute signal average to said large fire threshold value in a large fire augmentation scheme, and providing an indication of a detected fire condition when said absolute signal average exceeds said large fire threshold value.

24. The method of claim 1, further including the steps of maintaining a record of previously detected fire conditions and using said record in determining said predetermined threshold value and said selected range of values.

25. The method of claim 1, further including using a plurality of sensors in a corresponding plurality of channels in a multi-channel system to establish individual detected fire conditions, each sensor being used as set forth in claim 1.

26. The method of claim 25, wherein establishing a detected fire condition from said multi-channel system includes the further step of receiving an indication of detected fire condition from each different channel.

27. The method of claim 26, wherein, for each of said channels, said predetermined threshold value is dependent on the absolute signal averages of the other channels of said multi-channel system.

28. The method of claim 26, wherein the predetermined threshold value of each individual channel is subject to modification by cross-thresholding from the sensor signals of sensors in the other channels of said multi-channel system.

* * * * *